US005713827A

United States Patent [19]

Errington

[11] Patent Number: 5,713,827

[45] Date of Patent: Feb. 3, 1998

[54] CENTRIFUGAL FILTER DEVICE

[75] Inventor: Rowland Alexander Errington, Tamworth, Australia

[73] Assignee: Trylock Pty Ltd, Tamworth, Australia

[21] Appl. No.: 605,706

[22] Filed: Feb. 23, 1996

Related U.S. Application Data

[63] Continuation of Ser. No. 367,131, filed as PCT/AU93/00335, Jul. 8, 1993, abandoned.

[30] Foreign Application Priority Data

Jul. 8, 1992 [AU] Australia ..... PL3368

[51] Int. Cl.[6] ..... B04B 7/04; B04B 11/04

[52] U.S. Cl. ..... 494/56; 494/60; 494/67

[58] Field of Search ..... 494/60, 61, 62, 494/63, 27, 56, 57, 43, 67

[56] References Cited

U.S. PATENT DOCUMENTS

| | | | |
|---|---|---|---|
| 1,479,456 | 1/1924 | Cleveland . | |
| 3,825,177 | 7/1974 | Kohlstette et al. . | |
| 3,931,928 | 1/1976 | Kido . | |
| 3,991,935 | 11/1976 | Henning | 494/60 |
| 4,081,129 | 3/1978 | Stroucken . | |
| 4,341,342 | 7/1982 | Hara | 494/60 |
| 4,846,781 | 7/1989 | Knelson | 494/60 |
| 5,281,195 | 1/1994 | Swartzbaugh | 494/60 |

FOREIGN PATENT DOCUMENTS 1 203 177 8/1970 United Kingdom .

OTHER PUBLICATIONS

Derwent Abstract Accession No. K4555W/38, SU,A,443685 (Belyanin P.N.) 10 Apr. 1975.

Patent Abstracts of Japan, C-140, p. 110, JP,A,57-150461 (Kubota Tekko K.K) 17 Sep. 1982.

*Primary Examiner*—Charles E. Cooley
*Attorney, Agent, or Firm*—Richard M. Goldberg

[57] ABSTRACT

A centrifugal filter device includes a housing having an essentially cylindrical housing wall about an axis of the housing and an annular trough located radially inwardly of the housing wall, a cap fitted to the housing and having a lid spaced from an upper edge of the housing wall, the cap further comprising an annular side wall spaced radially outwardly from the housing wall and defining an annular catchment chamber having an annular tapered deflection surface therein, a first exit port in the side wall of the cap, a second exit port at the trough of the housing, an inner chamber situated within the housing and adapted to rotate about the axis, the inner chamber having an essentially cylindrical wall inwardly spaced from the cylindrical wall of the housing so as to define an annular space therebetween, an internal drain communicating an interior of the chamber with the trough of the housing, and an annular closure element having an opening communicating the interior of the chamber with the annular catchment chamber of the cap, and an inlet extending from outside the filter through the cap and the opening of the closure element to the interior of the chamber.

10 Claims, 1 Drawing Sheet

CENTRIFUGAL FILTER DEVICE

This application is a continuation of application Ser. No. 08/367,131 filed as PCT/AU93/00335 on Jul. 8, 1993 now abandoned.

FIELD OF THE INVENTION

This invention relates to a filter device and in particular a filter device useful for recovering purified liquid from sludges, emulsions etc.

BACKGROUND OF THE INVENTION

There is a need for a simple cheap device for recovering liquid from industrial sludges and emulsions etc., firstly, to enable reuse of liquid and, secondly, to reduce the need to dispose of large quantities of sludge or emulsion. Thus it is much more convenient to dispose of a small quantity of a relatively concentrated filtered material, for example, in a landfill.

Normal filtration is too slow and it is an object of the present invention to provide a simpler and more efficient filter.

U.S. Pat. No. 1,479,456 Cleveland discloses on page 1 at line 17 to 37:

> "One common method employed at the present time of de-watering activated sludge or similar material is to discharge the sludge into a rotatable drum, at a point near its bottom, which imparts rotation to the material and results in the cake or mass, contained in the sludge, being thrown and held into contact with the sides of the drum, while the liquid or effluent overflows and is carried off from the top of the drum. This method embodies many objectionable features, resulting in lower efficiency and consequently small capacity of the machine, due to the fact that sludge discharged at the bottom of the drum will not reach the maximum number of revolutions per minute until it has travelled the entire height of the drum, which results in a slow and inefficient separation of the cake or mass from the effluent, and requires subsequent re-handling of the effluent."

The disadvantages mentioned by Cleveland have not been experienced with the device according to the present invention and the advantages of the present invention are discussed below.

Referring to the Cleveland patent specification mentioned above, the device according to the invention provides an inexpensive, generally small capacity machine but at the same time does not suffer from the inherent vibration and short bearing life problems mentioned by Cleveland at lines 43 to 49 of page 1:

> "A further objection results from the fact that it is impossible to obtain an even flow of sludge, the same being fed by gravity, thereby resulting in vibration of the drum which is injurious to the same and causes great wear upon the supporting bearing."

The device according to the invention is intended to remove small quantities of solids from solutions such as cleaning solutions, for example, wherein 3 kilograms of sludge may be deposited in 1600 liters per day, such as in certain caustic solutions.

Furthermore, in the device according to the invention, contrary to the Cleveland's assertion, deposited material builds up less rapidly at the lower end of the rotating bowl without the need for his complex feed arrangement. In the device according to the invention, a high proportion, such as 25% by weight of material, is deposited at the lower level and this may be due to the region of delivery of the liquid-containing substance to be processed.

BRIEF SUMMARY OF THE INVENTION

This invention, therefore, provides a centrifugal filter device for treatment of liquid-containing substances which comprises:

- a rotatable inner chamber at least partially open in its upper region, as viewed in use; and
- a fixed outer housing surrounding the inner chamber; and
- means for delivery of the liquid-containing substance to selected region of the inner chamber, wherein the rotatable inner chamber is adapted to collect concentrated waste material deposited from the liquid-containing substance, and which inner chamber is removable to empty the concentrated waste material for disposal, the waste material being concentrated in the lower region of the inner chamber upon rotation, and wherein the major portion of the liquid exits from the inner chamber out of its open top upon rotation, the inner chamber being provided with drainage means to remove remaining liquid from the waste material. In accordance with an aspect of the present invention, a centrifugal filter device includes a housing having an essentially cylindrical housing wall about an axis of the housing and an annular trough located radially inwardly of the housing wall, a cap fitted to the housing and having a lid spaced from an upper edge of the housing wall, the cap further comprising an annular side wall spaced radially outwardly from the housing wall and defining an annular catchment chamber having an annular tapered deflection surface therein, a first exit port in the side wall of said cap, a second exit port at the trough of the housing, an inner chamber situated within said housing and adapted to rotate about said axis, said inner chamber having an essentially cylindrical wall inwardly spaced from the cylindrical wall of the housing so as to define an annular space therebetween, an internal drain communicating an interior of the chamber with the trough of the housing, and an annular closure element having an opening communicating the interior of the chamber with the annular catchment chamber of the cap, and an inlet extending from outside the filter through said cap and the opening of the closure element to the interior of the chamber.

DETAILED DESCRIPTION OF THE INVENTION

Figure 1:
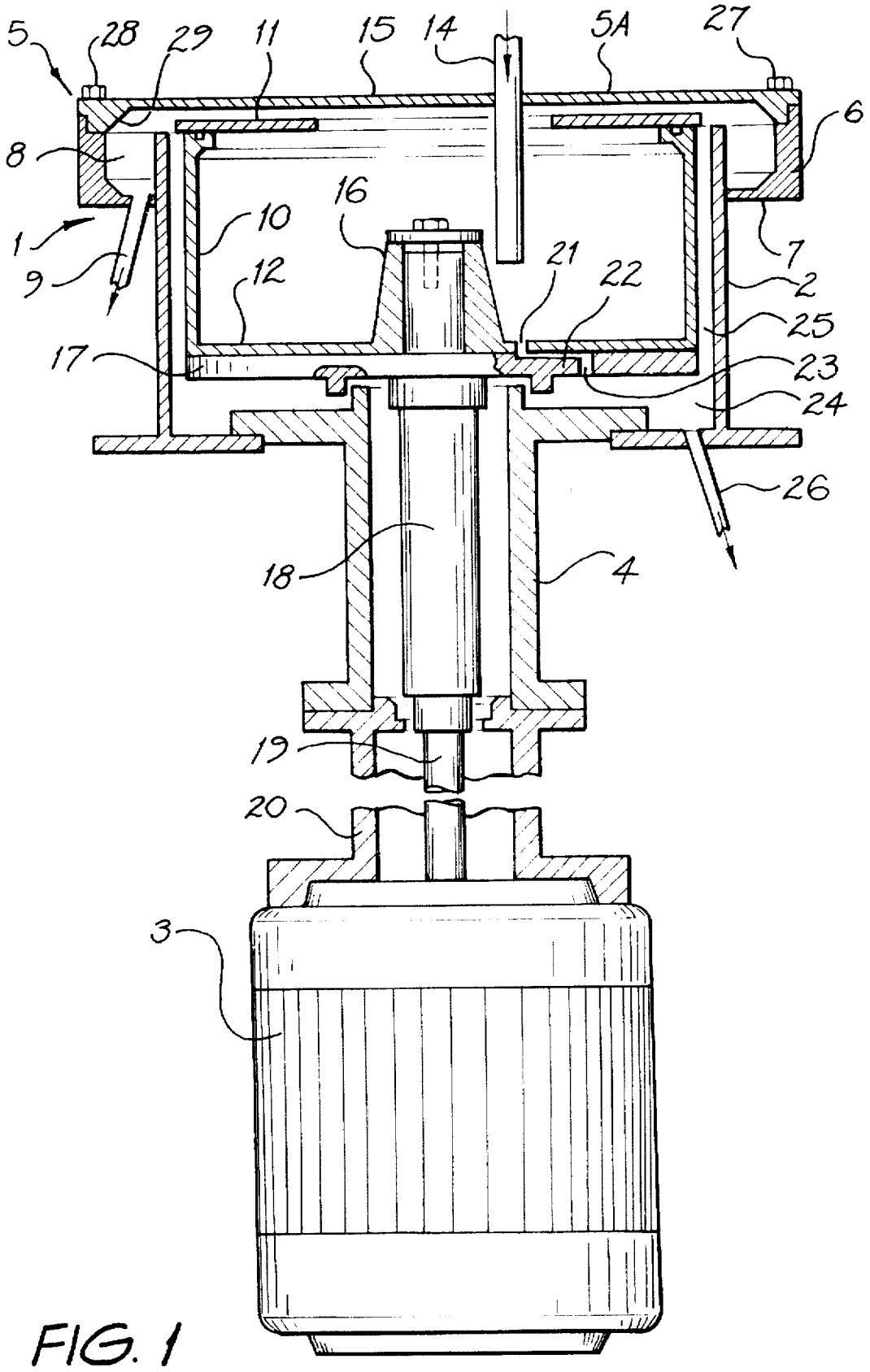
FIG. 1 is a side view partly in cross-section of one embodiment of the invention.

The rotatable inner chamber is conveniently centrally located with respect to the vertical axis, as viewed in use, of the outer housing. Preferably the inner chamber is generally cylindrical having a wall upon which the concentrated waste material collects. Furthermore the inner chamber is preferably supplied with a partial closure which limits upward flow, as viewed in use, of concentrated waste material.

The housing comprises an outer wall which preferably extends substantially to the top, as viewed in use, of the inner chamber. The housing comprises a circumferential trough around the inner chamber.

Preferably a cap, comprising a removable lid, fits over the top of the housing. More preferably the cap is provided with a circumferential downwardly extending side wall and a circumferential inwardly extending bottom. In combination the side wall and bottom of the cap and the top of the cap, form a circumferential chamber for purified liquid. Preferably at least a portion of the internal surface of the cap slopes inwardly and downwardly towards the vertical axis of the housing. Sloping in this way reduces the tendency for "splashback" of purified liquid onto the inner chamber thus braking the inner chamber.

Thus raw liquid-containing substance is preferably fed through the top of the cap, as viewed in use, into the inner chamber and purified liquid is extracted from the circumferential chamber formed as described above. Preferably the inlet for the liquid-containing substance supplies the liquid-containing substance to a region near the bottom of the inner chamber, more preferably near its central axis.

The term "liquid-containing substance" is to be given a broad interpretation as including material comprising various quantities of a solid usually in the form of a sludge, the sludge material being from relatively dilute to relatively concentrated.

This invention has been found particularly useful in removing sludge from alkaline baths and various cleaning solvents.

Turning to FIG. 1, a centrifugal filter device comprises a fixed, outer centrifuge housing 2 connected in use to a lower motor 3 by an extended circumferential casing 4. Housing 2 is supplied with a cap 5, comprising a lid 5A from which depends a circumferential side wall 6. Side wall 6 is provided with a bottom 7 which defines an internal, circumferential catchment chamber 8. A first exit port 9 leads from the bottom of circumferential chamber 8.

A cylindrical inner chamber 10 is located inside housing 2 and is supplied with an upper, inwardly extending, partial circumferential closure 11 and bottom 12. An inlet 14 extends through an opening 15 defined by partial closure 11 and further extends towards a demountable hub means 16.

Inner chamber 10 is mounted on a generally circular plate means a supporting hub 17 which is in turn connected to a generally cylindrical shaft means 18. Shaft means 18 is connected to a spindle 19 leading from motor 3 and located centrally in an upper motor shroud means 20.

Returning to inner chamber 10, an internal drain 21 located in bottom 12 leads to a channel 22,which in turn leads to external drain 23. External drain 23 leads into circumferential trough 24 at the bottom of space 25 which is located between housing 2 and inner chamber 10. A second exit port 26 leads out of trough 24.

In use, raw liquid-containing substance is injected into spinning inner chamber 10, concentrated sludge gathering on its vertical cylindrical wall. Liquid is centrifuged out through opening 15 and into circumferential chamber 8 and drains through first exit port 9. The inwardly and downwardly sloping surface of the lower circumferential edge of cap 5 is indicated by numeral 29 and projects liquid downwardly into circumferential chamber 8.

After rotation of bowl 10 has ceased, the lid 5 may be removed from housing 6 using screw means 27 and 28, the lid 11 may then be removed from bowl 10 for cleaning out of concentrated sludge. When bowl 10 rotation ceases an amount of liquid remains in the bowl with the concentrated solids, this liquid drains from the bowl through internal drain 21, channel 22 and external drain 23 into trough 24 and out through second exit port 26.

The filter device described is of particular value for batch operation.

I claim:

1. A centrifugal filter comprising:

a housing having an essentially cylindrical housing wall about an axis of the housing and an annular trough located radially inwardly of the housing wall, a cap fitted to the housing and having a lid spaced from an upper edge of the housing wall, the cap further comprising an annular side wall spaced radially outwardly from the housing wall and defining an annular catchment chamber having an annular tapered deflection surface therein, a first exit port in the side wall of said cap, a second exit port at the trough of the housing, an inner chamber situated within said housing and adapted to rotate about said axis, said inner chamber comprising:

an essentially cylindrical wall inwardly spaced from the cylindrical wall of the housing so as to define an annular space therebetween, an internal drain communicating an interior of the chamber with the trough of the housing, and an annular closure element having an opening communicating the interior of the chamber with the annular catchment chamber of the cap, and an inlet extending from outside the filter through said cap and the opening of the closure element to the interior of the chamber.

2. The centrifugal filter of claim 1 wherein said closure element is adapted to restrain concentrated waste material in the chamber.

3. The centrifugal filter of claim 1, wherein the chamber extends above the upper edge of the housing wall.

4. The centrifugal filter of claim 1, wherein:

said lid is removably affixed to the housing wall, and said annular tapered deflection surface is provided on an under-surface of the lid.

5. The centrifugal filter of claim 1, wherein said side wall comprises a circumferential tapered surface situated in opposition to said annular tapered deflector surface.

6. The centrifugal filter of claim 1, wherein said chamber comprises a hub by which said chamber is affixed to a drive shaft.

7. The centrifugal filter of claim 6, further comprising a motor affixed to the housing and drivingly connected to said drive shaft.

8. The centrifugal filter of claim 7, wherein said hub has a frusto-conical shaped outer surface.

9. The centrifugal filter of claim 8, wherein said inlet is adapted to direct a substance to the frusto-conical shaped outer surface of the hub.

10. A method of dewatering a liquid containing substance with the centrifugal filter of claim 7, the method comprising the step of:

delivering the liquid containing substance to the centrifugal filter via said inlet, activating said motor so as to rotate said inner chamber whereby said substance is retained against an inner surface of said cylindrical wall of the chamber while liquid passes through said opening and to said annular catchment chamber of the cap so as to allow liquid to drain from the filter via said first exit port, and deactivating said motor so that said inner chamber ceases rotating such that any remaining liquid drains from the chamber by passing through said internal drain and then through said second exit port.

* * * * *